US007101318B2

(12) United States Patent
Holmes

(10) Patent No.: US 7,101,318 B2
(45) Date of Patent: Sep. 5, 2006

(54) OMNI-DIRECTIONAL TREADMILL

(76) Inventor: Kendall Holmes, 100 Estate South Gate Hills, St. Croix, VI (US) 00824

( * ) Notice: Subject to any disclaimer, the term of this patent is extended or adjusted under 35 U.S.C. 154(b) by 0 days.

(21) Appl. No.: 11/126,104

(22) Filed: May 10, 2005

(65) Prior Publication Data

US 2005/0266963 A1 Dec. 1, 2005

Related U.S. Application Data

(60) Provisional application No. 60/569,555, filed on May 10, 2004.

(51) Int. Cl.
*A63B 22/00* (2006.01)

(52) U.S. Cl. ..... 482/54; 482/51

(58) Field of Classification Search ..... 482/51, 482/54; 119/700
See application file for complete search history.

(56) References Cited

U.S. PATENT DOCUMENTS 5,733,228 A * 3/1998 Stevens ..... 482/54
5,813,947 A * 9/1998 Densmore ..... 482/51
6,224,516 B1 * 5/2001 Disch ..... 482/54

* cited by examiner

*Primary Examiner*—Glenn E. Richman
(74) *Attorney, Agent, or Firm*—Synnestvedt & Lechner LLP

(57) ABSTRACT

The present invention is an exercise device incorporating a treadmill platform and treadmill podium, whereby the user may walk/run on the treadmill, not only in the forward direction, but also in the side-to-side and backwards directions described above, while still facing the podium. This present invention provides a treadmill having a podium that can be adjusted with respect to the platform, so that regardless of the direction of travel in which the user is traveling on the platform (forward, side-to-side, or backwards), the user will always be facing the podium. This is accomplished by providing a pivoting podium element that pivots with respect to the platform.

7 Claims, 5 Drawing Sheets

OMNI-DIRECTIONAL TREADMILL

CROSS-REFERENCE TO RELATED APPLICATIONS

This application is based on and claims priority to U.S. Provisional Application No. 60/569,555, filed May 10, 2004, the contents of which is incorporated fully herein by reference.

BACKGROUND OF THE INVENTION

1. Field of the Invention

This invention is in the field of exercise equipment, particularly, to an exercise method involving omni-directional use of a treadmill and, more particularly, to an exercise device that facilitates such omni-directional use.

2. Description of the Related Art

A treadmill is a piece of exercise equipment that simulates the action of walking or running while allowing the user to remain essentially in one place. A typical treadmill consists of a flat stationery member, sometimes referred to as a deck, and a substantially vertical member resembling a podium, sometimes referred to as the neck.

The deck typically has a moving surface of some kind, usually a belt driven by motorized rollers at the front and back of the deck. The surface of the belt on which the user treads moves in a direction away from the podium, and the user walks or runs in a direction towards the podium, thereby creating a moving walkway on which to exercise. Most treadmills have user-definable variables, such as speed, incline of the deck, and the like, all of which allow the user to simulate various walking and running conditions. Using prior art treadmills allows the user to develop muscles that are typically exercised during forward running or walking.

As part of a training regimen, many athletes perform exercises designed to develop muscles other than those that are developed from forward running or walking. Since treadmills are designed for forward operation only, some athletes forgo the use of the treadmill and do exercises in a gym or on a field whereby they move from side to side, or walk or run backwards, to develop the muscles associated with such movements. It would be desirable, therefore, to be able to simulate the same sideways and backwards movements in a stationary location, such as on a treadmill.

SUMMARY OF THE INVENTION

In accordance with the first embodiment of the present invention, a standard treadmill is utilized in a manner contrary to that suggested by the manufacturer, to increase the benefit to be gained from use of the treadmill. More specifically, in accordance with the present invention, a user stands in a side-ways position on the platform of a treadmill (e.g., so that the podium is situated either to the left or right of the user, depending upon which sideways direction the user is standing), and then operates the treadmill platform. The user then performs a side-to-side striding technique whereby he or she is essentially walking sideways on the treadmill platform. This provides a workout for various portions of the body that are not typically worked out during use of the treadmill in the traditional manner.

Similarly, turning 180° from the recommended position (so that the user is facing away from the podium) and then walking on the treadmill platform while it is in a moving state allows the user to simulate a backwards walking movement, which, again, works out different muscles than those that are worked out while operating the treadmill in the recommended forward-walking orientation.

A second embodiment of the present invention is an exercise device incorporating a treadmill platform and treadmill podium, whereby the user may walk/run on the treadmill, not only in the forward direction, but also in the side-to-side and backwards directions described above, while still facing the podium. This embodiment of the present invention provides a treadmill having a podium that can be adjusted with respect to the platform, so that regardless of the direction of travel in which the user is traveling on the platform (forward, side-to-side, or backwards), the user will always be facing the podium. This is accomplished by providing a pivoting podium element that pivots with respect to the platform.

It is noted that the drawings are not to scale and elements therein may not be proportional relative to each other.

DETAILED DESCRIPTION OF THE PREFERRED EMBODIMENTS

Figure 1A:
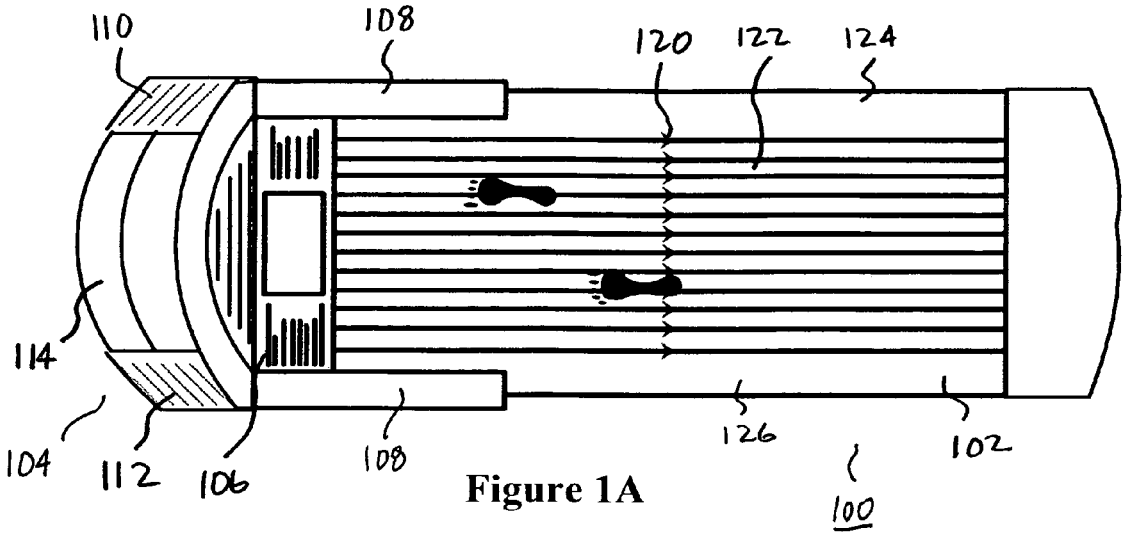
FIGS. 1A and 1B illustrate the present invention in the "normal" treadmill position.
Figure 1B:
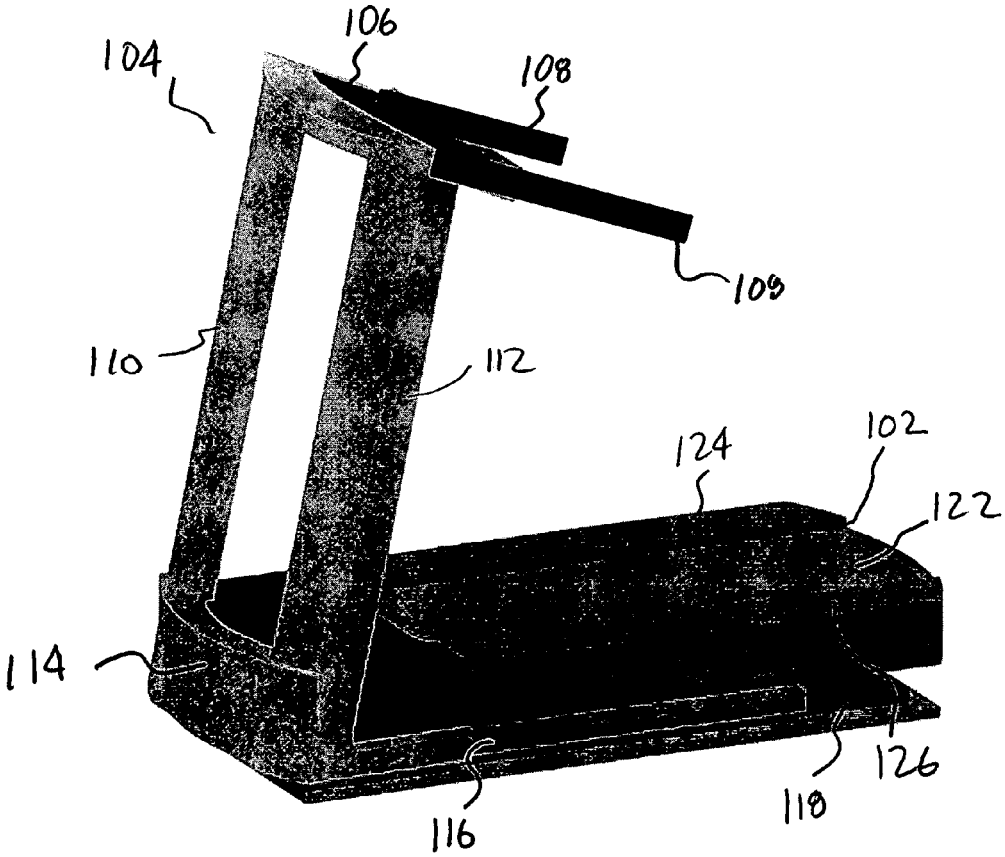

FIGS. 1A and 1B illustrate the present invention in the "normal" treadmill position. A deck assembly 102 and a podium assembly 104 are integrated in such a way that they resemble the typical treadmill. More specifically, deck assembly 102 includes a moving belt 122 bordered on either side by non-moving side elements 124 and 126. Side elements 124 and 126 are frequently used by users to stand on when the user wants to stop immediately and does not want to wait for the moving belt 122 to come to a complete stop. In a well known manner, drive motors and rollers (not shown) are controllable to move the moving belt 122 in a direction along the longitudinal axis of deck assembly 102 such that the moving surface on which the user treads is moving away from the podium assembly 104, as indicated by the directional arrows 120 shown on the moving belt 122.

The podium assembly 104 includes a display/control area 106. The display/control area 106 typically will include operational controls, displays for displaying speed of the belt, calories burned, time elapsed, etc. Many treadmills also included handles 108 to give the user something to grab onto for support in the event of a stumble.

Legs 110 and 112 of podium assembly 104 provide a support means for display/control area 106 and are connected to a base 114. In accordance with the present invention, base 114 is connected to a pivoting platform 116. Pivoting platform 116 is situated between deck assembly 102 and a base platform 118. Pivoting platform 116, when positioned as shown in FIGS. 1A and 1B, has a longitudinal axis that is parallel with the longitudinal axis of deck assembly 102. As will be described in more detail below, pivoting platform 116 is pivotally mounted between deck assembly 102 and base platform 118, so that it may move about the perimeter of deck assembly 102.

Figure 2A:
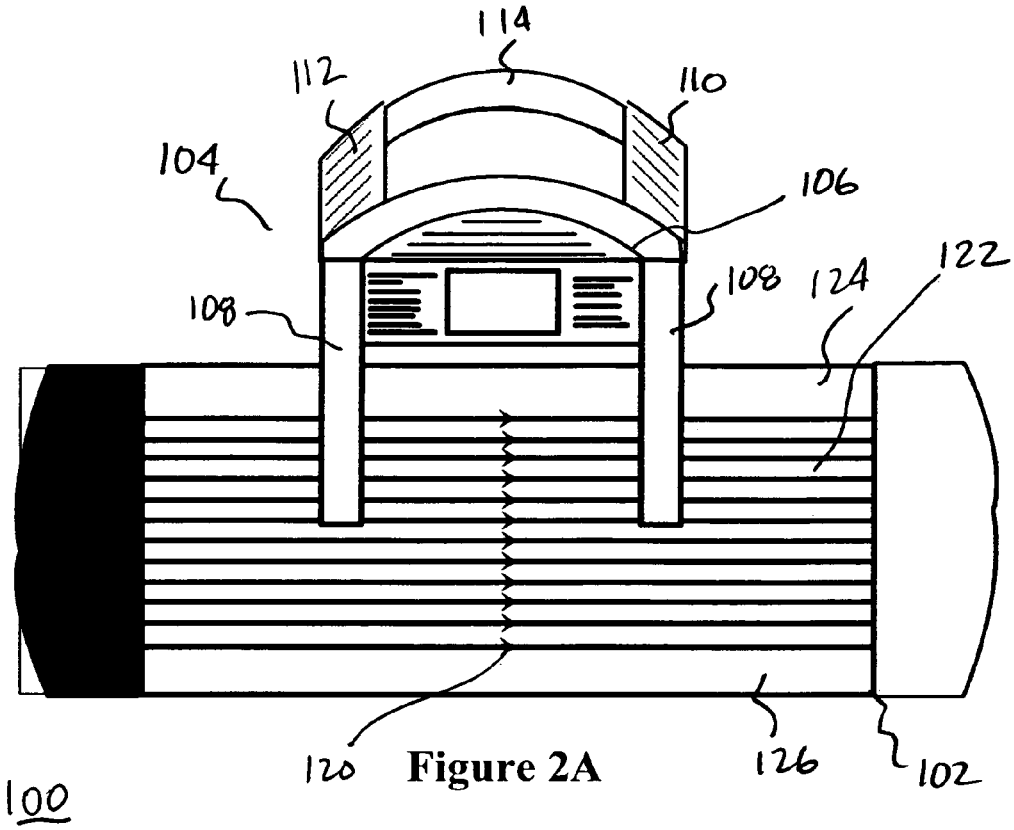
FIGS. 2A and 2B illustrate the present invention in a right-facing sideways position.
Figure 2B:
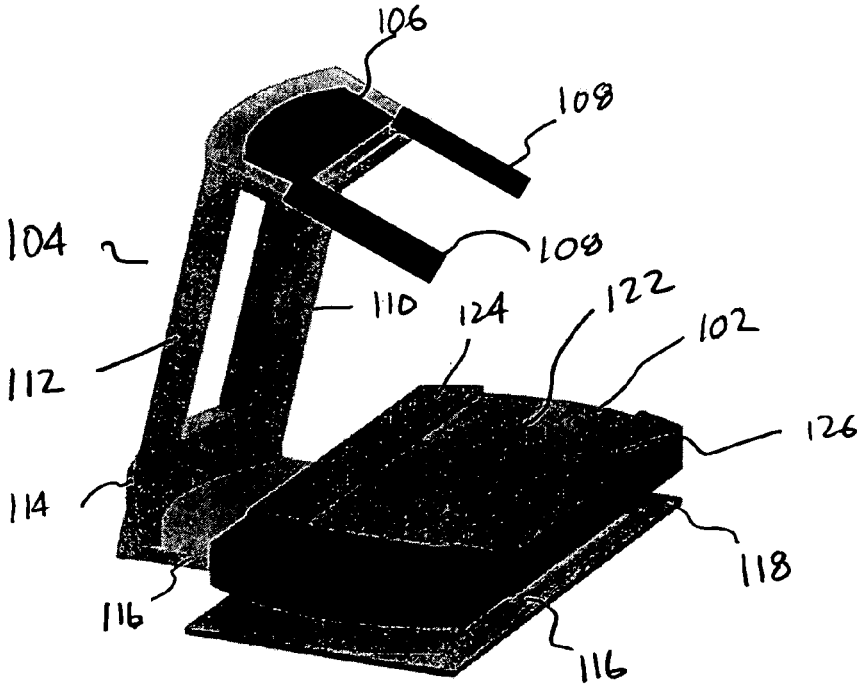

FIGS. 2A and 2B illustrate the present invention in a right-facing sideways position. In this position, the podium assembly 104 has been rotated 90° to the right from "normal" so that a user facing the podium assembly 104 is facing perpendicular to the direction of movement of the belt 122, with the belt moving from the user's left to the user's right. In this position, the longitudinal axis of pivoting platform 116 is perpendicular to the longitudinal axis of deck assembly 102. Since the pivoting platform 116 can pivot between deck assembly 102 and base platform 118, the podium assembly 104 is movable to this position. In a preferred embodiment, a locking mechanism may be used to assure that the podium assembly 104 remains in this position during use. Numerous locking mechanisms are known in the art and the specific locking mechanism used is a matter of design choice and will be apparent to a designer of ordinary skill in the art.

Once the device has been pivoted to this position, the user simply stands on the deck assembly 102 facing the podium assembly 104, and activates the movement of the belt 122, and begins sideways striding. It is recommended that, at least at first, the speed of the belt 122 be kept very low, e.g., 2 mph or less, at least until the user gets used to the sideways motion. By using the device in this position, the user will develop muscles needed to stride from side to side.

Figure 3A:
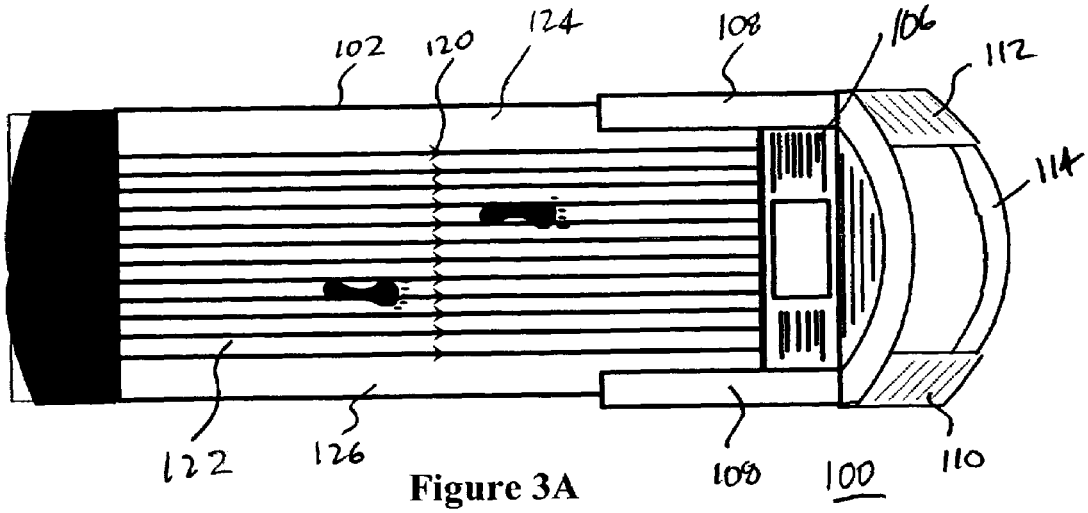
FIGS. 3A and 3B illustrate the present invention in the backward position.
Figure 3B:
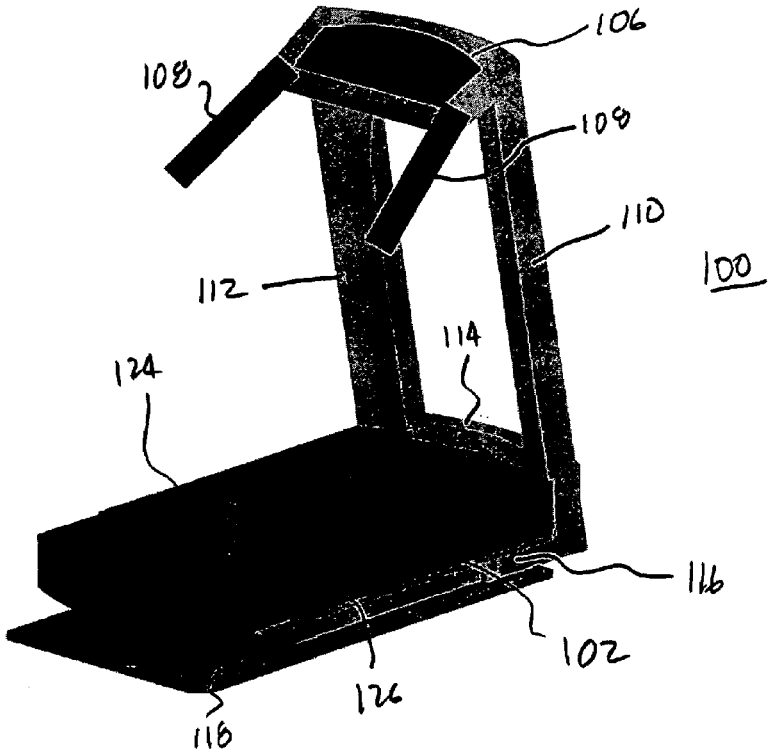

FIGS. 3A and 3B illustrate the present invention in the backward position. As can be seen, the podium assembly has been pivoted 180° from "normal" so that now a user facing the podium assembly 104 must walk backwards when the belt 122 is operating. By using the device of the present invention in this manner, the user develops muscles that are utilized during the act of walking backwards.

Figure 4A:
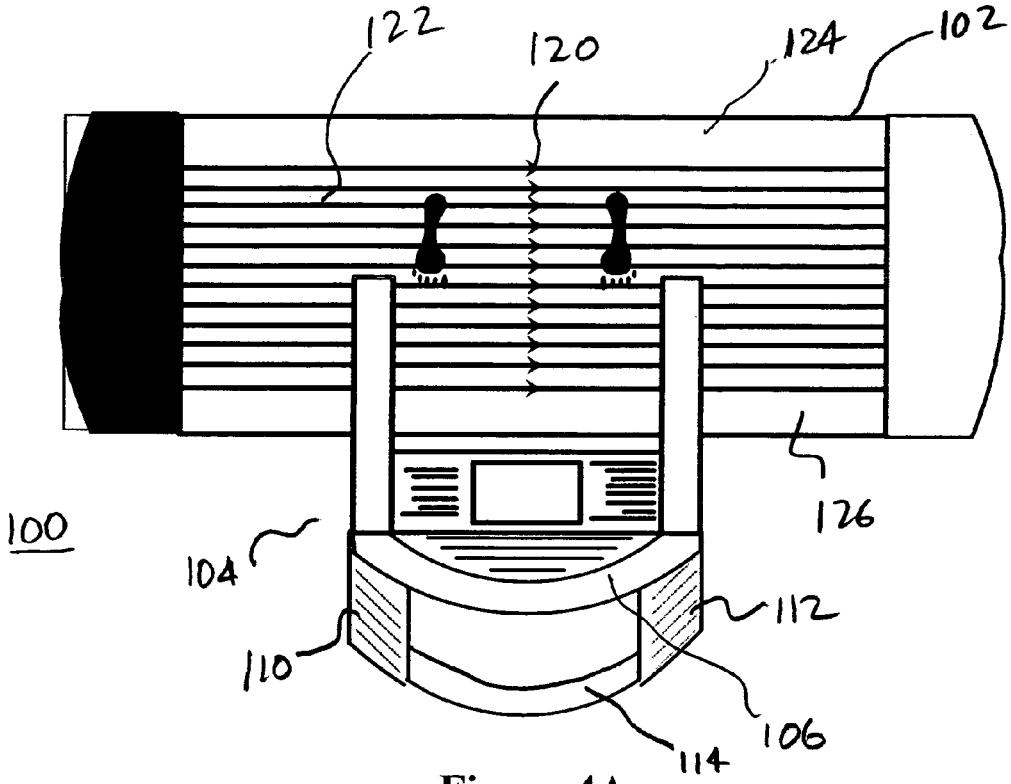
FIGS. 4A and 4B illustrate the device of the present invention in the left-facing sideways position.
Figure 4B:
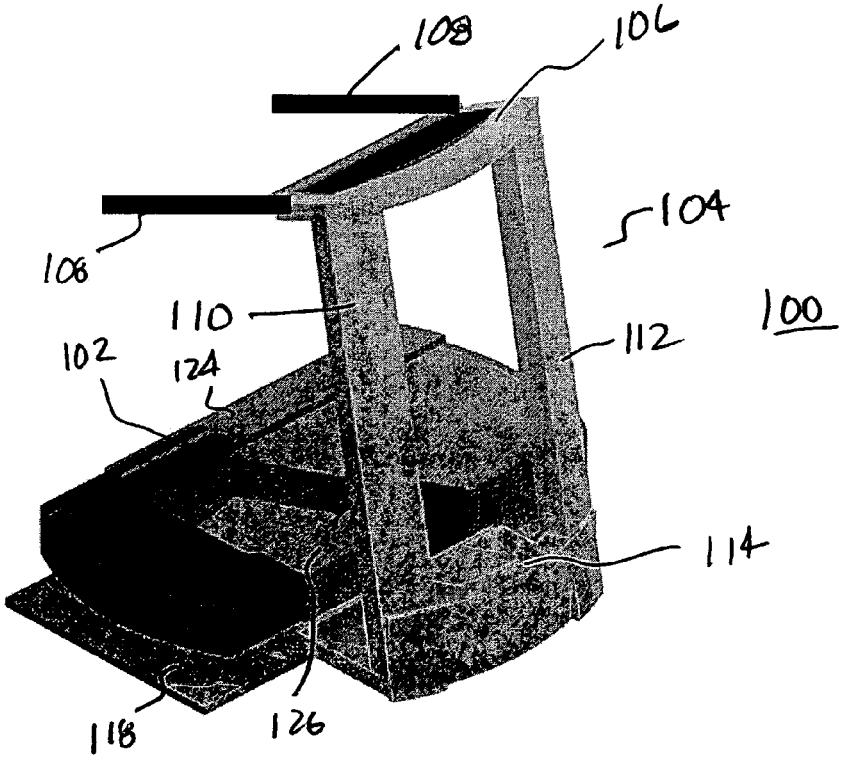

Finally, FIGS. 4A and 4B illustrate the device of the present invention in the left-facing sideways position. As can be seen, the podium assembly 104 has been pivoted 90° to the left of normal, and a user of the device facing the podium assembly 104 will be standing perpendicular to the direction of movement of the belt 122. In this position, a user will start the belt 122 and will stride side-to-side, with the belt 122 moving from the user's right to the user's left. This action will develop muscles used during this side-to-side motion.

Figure 5:
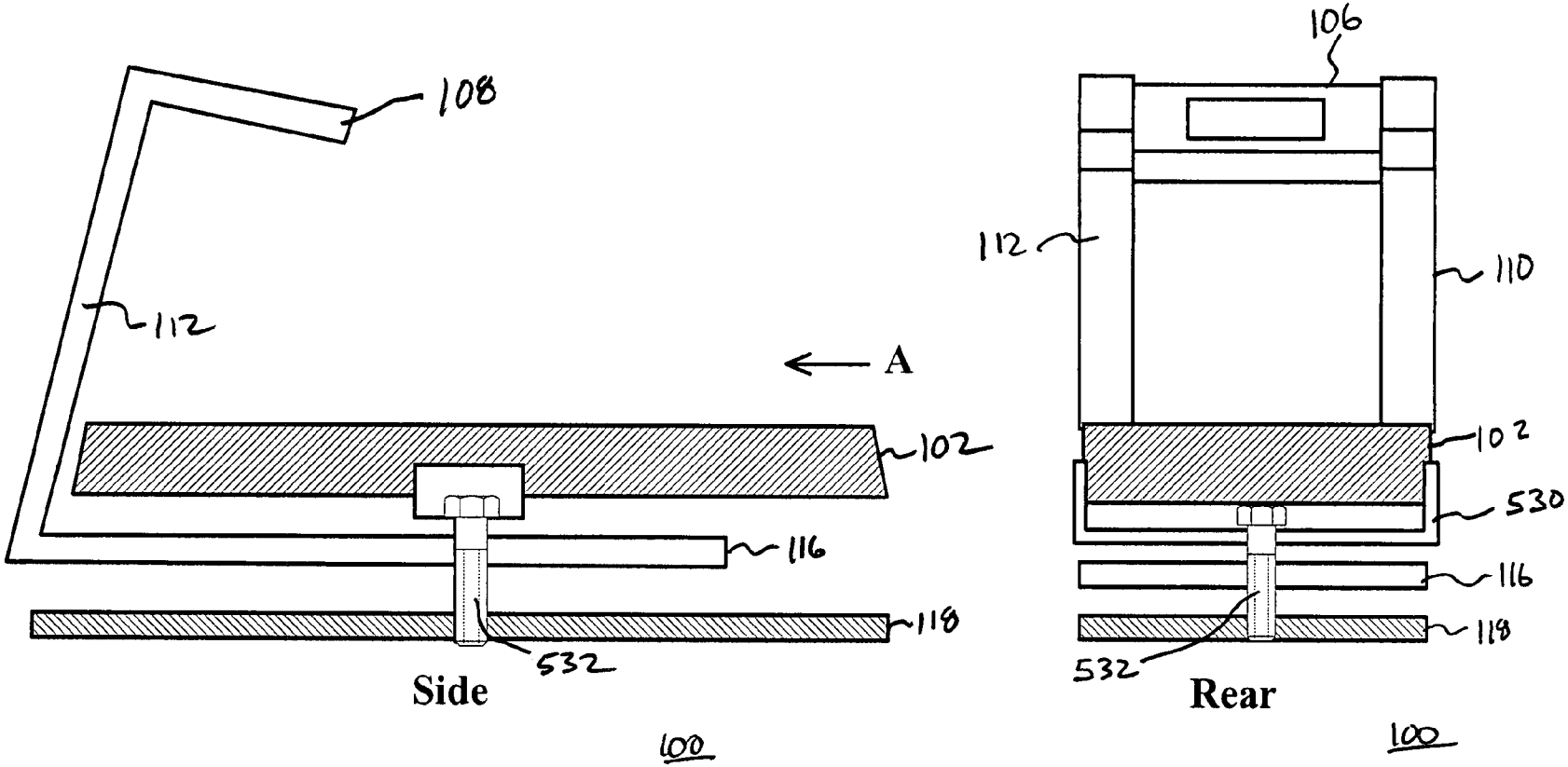
FIG. 5 illustrates an example of a configuration enabling the platform to pivot, as described.

As noted above, the present invention requires that the pivoting platform 116 be able to pivot with respect to the deck assembly 102 and base platform 118. Numerous methods of enabling such a pivot motion will be apparent to a designer of ordinary skill in the art. One such method is illustrated in FIG. 5. FIG. 5 illustrates, in exaggerated form, a side and rear view (looking along arrow "A" in the side view) of a configuration enabling pivoting platform 116 to pivot as described.

Referring to FIG. 5, a bracket 530 is affixed to deck assembly 102 along the side elements 124 and 126. Since belt 122 wraps around and underneath deck assembly 102 in a well known manner, there must be clearance between bracket 530 and deck assembly 102 to allow free travel of the belt 122. A bolt 532 affixes bracket 530 to base platform 118. Bolt 532 passes through pivoting platform 116 such that bracket 530 (and deck assembly 102 attached thereto) is fixedly attached to base platform 118 while allowing pivoting platform 116 to move freely therebetween. As noted above, locking mechanisms may be provided to lock pivoting platform 116 in a desired position.

Although the example of FIG. 5 illustrates the rotation of podium assembly 104 around a fixed point (bolt 532), it is understood that the movement of the podium 104 about the perimeter of deck assembly 102 can be achieved using numerous other methods. For example, the pivoting platform 116 could be slotted and engage with a stud or other member cooperating with the slot(s) of pivoting platform 116, and the podium assembly 104 could thus be moved about the perimeter by pulling the pivoting platform 116 outward, moving it around to the desired position, and then sliding it back to engage it in place, in the new position, between deck assembly 102 and base platform 118. These methods are included as part of the present invention.

Further, although the figures illustrate the podium assembly pivoted to positions whereby the longitudinal axis of the pivoting platform is either perpendicular to or parallel to the longitudinal axis of deck assembly 102, the podium assembly can as well be pivoted to any position whereby the longitudinal axis of pivoting platform 116 is between a parallel orientation and a perpendicular orientation with respect to the longitudinal axis of the deck assembly 102.

For the display/control area 106 to be functional, the only requirement different from that of the ordinary treadmill is that electrical connections between the podium assembly 104 and the deck assembly 102 (including the motor and any sensors) be maintained in an operational state. There are numerous methods known in the art for accomplishing the maintaining of these connections, including the use of wiring harnesses that are of sufficient length to enable such movement and/or the use of sliding electrical contacts that slide along a conductive area so that, even when rotated, the electrical contacts maintain contact with the conductive area on which it slides, thereby maintaining the electrical connections. Further, it is contemplated that wireless connections could be used between the controls and the elements that they control, and/or the display devices and the elements driving them, to thus avoid the need for physical electrical connections between the display/control area 106 and the deck assembly 102.

By providing an upper support assembly and display that rotates in the described manner, a user may safely use a treadmill to exercise muscles used in normal frontward movement, side-to-side movement, and backwards movement. The user is always facing the display device and thus does not have to turn to see them. Further, if the podium is equipped with handles, the handles are oriented for use to give the user stability. The present invention provides a treadmill having a podium that can be adjusted with respect to the platform, so that regardless of the direction of travel in which the user is traveling on the platform, the user will always be facing the podium.

Although the present invention has been described with respect to a specific preferred embodiment thereof, various changes and modifications may be suggested to one skilled in the art and it is intended that the present invention encompass such changes and modifications as fall within the scope of the appended claims.

I claim:

1. An exercise apparatus, comprising:

a treadmill having a deck assembly providing a continuously-moveable surface moveable along a longitudinal axis of said deck assembly, on which a user treads during use of said apparatus;

a podium assembly pivotally coupled to said deck assembly, said podium assembly pivotable around the perimeter of said deck assembly.

2. The exercise apparatus of claim 1, further comprising:

a base platform coupled to and underneath said deck assembly so as to leave an opening between said deck assembly and said base platform, said podium assembly being pivotally coupled between said deck assembly and said base platform in said opening.

3. The exercise apparatus of claim 2, wherein said podium assembly comprises:

a pivoting platform coupled between said deck assembly and said base platform;

a base portion coupled to said pivoting platform; and a control/display element coupled to and supported by said base portion, wherein a user of said apparatus faces said control/display element when using said apparatus.

4. The exercise apparatus of claim 3, wherein said pivoting platform has a longitudinal axis, and wherein said pivoting platform is pivotable to positions whereby the longitudinal axis of said pivoting platform intersects with the longitudinal axis of said deck assembly.

5. The exercise apparatus of claim 4, wherein said pivoting platform is pivotable to positions whereby the longitudinal axis of said pivoting platform is perpendicular to the longitudinal axis of said deck assembly.

6. The exercise apparatus of claim 5, wherein said pivoting platform is pivotable to positions whereby the longitudinal axis of said pivoting platform is parallel to the longitudinal axis of said deck assembly.

7. The exercise device of claim 6, wherein said podium assembly includes handles providing support to a user of said device as needed.

* * * * *